United States Patent [19]

Thompson et al.

[11] Patent Number: 4,894,643

[45] Date of Patent: Jan. 16, 1990

[54] APPLIANCE DOOR ALARM APPARATUS

[75] Inventors: Herbert A. Thompson, Cumberland; Glenn J. Doell, No. Providence, both of R.I.

[73] Assignee: Texas Instruments Incorporated, Dallas, Tex.

[21] Appl. No.: 344,779

[22] Filed: Apr. 28, 1989

[51] Int. Cl.[4] ..... G08B 23/00

[52] U.S. Cl. ..... 340/593; 62/131; 340/585

[58] Field of Search ..... 340/593, 594, 585, 586, 340/529, 540, 545; 361/105; 307/116, 117; 62/131 X, 129

[56] References Cited

U.S. PATENT DOCUMENTS 4,707,684 11/1987 Janke et al. ..... 340/585

*Primary Examiner*—Joseph A. Orsino
*Assistant Examiner*—Geoff Sutcliffe
*Attorney, Agent, or Firm*—John A. Haug; James P. McAndrews; Melvin Sharp

[57] ABSTRACT

An aural or visual alarm is arranged to be actuated upon leaving a door to an appliance open longer than a preselected period of time. An automatically resettable disarming device may be included to permit leaving the door open intentionally for an extended time to permit appliance cleaning or the like.

7 Claims, 2 Drawing Sheets

APPLIANCE DOOR ALARM APPARATUS

FIELD OF THE INVENTION

This invention relates in general to appliances such as refrigerators and more particularly to a device for providing a warning signal when an appliance door has been left open more than a preselected period of time.

BACKGROUND OF THE INVENTION

Although appliances such as refrigerators and freezers can be run reasonably efficiently with a door thereto opened from time to time to provide access to the interior of the appliance a great deal of energy can be wasted if the door is accidentally left ajar for extended periods of time.

It is an object of the present invention to provide a warning signal, aural or visual, indicative of this condition in which an appliance door is left ajar longer than a preselected period of time. Yet another object is the provision of such a signal without adding significantly to the cost of the appliance. These and other objects and advantages will become more apparent from the following detailed description considered with the accompanying drawings.

SUMMARY OF THE INVENTION

Briefly, in accordance with the invention, an electrically energizable alarm indicator is coupled to a thermostat which is disposed in heat transfer relation with a light bulb mounted in the appliance. The light bulb is energized upon opening of the appliance door thereby generating heat which is transferred to the thermostat. When the temperature of the thermostat reaches a selected level it actuates to open a set of contacts and cause current to flow through the alarm indicator. According to a feature of the invention a single alarm indicator can be used for a plurality of lights by coupling the alarm indicator across all the thermostats. According to another feature a separate-manually operable alarm shut-off switch is coupled across the alarm indicator so that closing of the contacts of the alarm shut-off switch bypasses the alarm indicator when the door is to be kept open intentionally for extended periods of time, as for cleaning and the like.

DETAILED DESCRIPTION OF PREFERRED EMBODIMENTS

Household refrigerators typically contain internal light bulbs activated by a door switch. These bulbs can get very hot if left on too long. In order to prevent damage to the plastic liner of the refrigerator due to excessive heat it is common to mount a thermostat in heat conductive relationship with the bulb and electrically coupled thereto so that after a preselected period of time the thermostat will actuate to open a circuit de-energizing the bulb.

Figure 1:
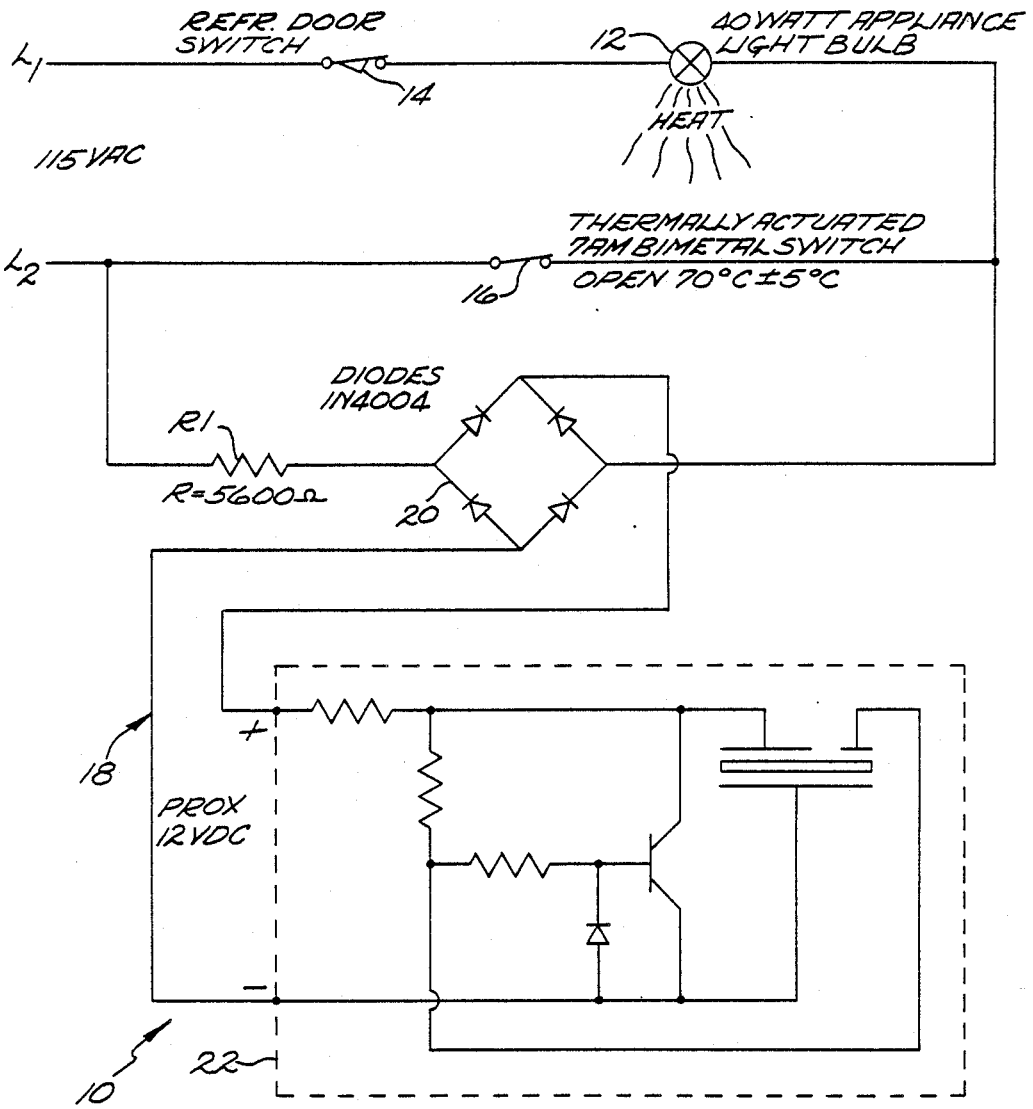
FIG. 1*a* is schematic diagram of a first embodiment made in accordance with the invention.

With reference to FIG. 1 an alarm system 10 is shown comprising a conventional light bulb connected electrically in series with refrigerator door switch 14 and thermally actuatable switch or thermostat 16 between supply lines L1, L2. Alarm indicator 18 is electrically connected in parallel with switch 16 and comprises a rectifier 20 and a piezoelectric buzzer unit 22. A selected impedance R1 is connected in series with rectifier 20 as will be described below.

Switch 16 and bulb 12 are used to provide the function of a thermal time delay relay. That is the alarm indicator will not be operated whenever the door is opened under normal conditions, i.e. for short periods of time. However if the door is left open for a preselected period the thermostat opens causing the alarm indicator to be energized through the light bulb. Since the alarm indicator is in series with the bulb when the thermostat is open the alarm indicator circuit is provided with sufficiently high impedance relative to the impedance of the bulb to cause the bulb to go out, or at least to become very dim, and the alarm indicator to be energized. The alarm impedance should be at least 10 times that of the bulb. For example, for a 40 watt, 120 volt appliance bulb the alarm impedance should be 3.6K ohms minimum. As soon as the thermostat opens it begins to cool and eventually resets, bypassing the alarm indicator, turning it off and turning on the light again. This cycling can continue indefinitely. Closing of the door, however, immediately de-energizes the alarm indicator and allows the thermostat to reset as soon as it cools sufficiently.

In a system built as shown in FIG. 1 the appliance light bulb 12 was a 40 watt bulb, the thermostatic switch 16 was a 7 AM bimetal switch manufactured by Texas Instruments Incorporated, R1 was a 3 W resistor of 5600 ohms, the diodes in rectifier 20 were 1N4004 and the buzzer unit 22 was a Panasonic piezoelectric unit designed for 2–30 Vdc, 15 mA at 12 Vdc, 2.5 KHz audio frequency and 95 dB sound pressure level at 12 V, 10 cm distance. In operation, buzzer unit 22 was actuated when the door was left open for approximately 10 minutes.

It will be understood that the rectifier can be full or half wave as desired and that any suitable alarm indicator can be used in the system provided by the invention, either aural or visual. Typically R will be selected to be between 3.6K and 15K ohms and he preselected will be between approximately 5 and 15 minutes. The time is controlled by the proximity of the (7 AM) thermostat to the bulb and by the temperature calibration of the (7 AM) thermostat.

Figure 2:
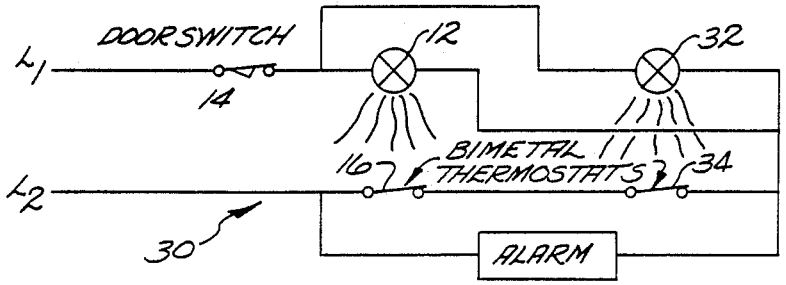
FIGS. 2–4 are schematic diagrams of alternate embodiments.

In the event that there are plurality of light bulbs in the appliance operated by the same door switch the system 30 shown in FIG. 2 provides a suitable alarm utilizing a single alarm indicator 18 for all the bulbs. Although any number of bulbs could be employed, FIG. 2 shows two bulbs, 12 and 32, in heat conductive relationship with thermostatic switches 16 and respectively with alarm indicator 18 connected across both thermostatic switches.

Figure 3:
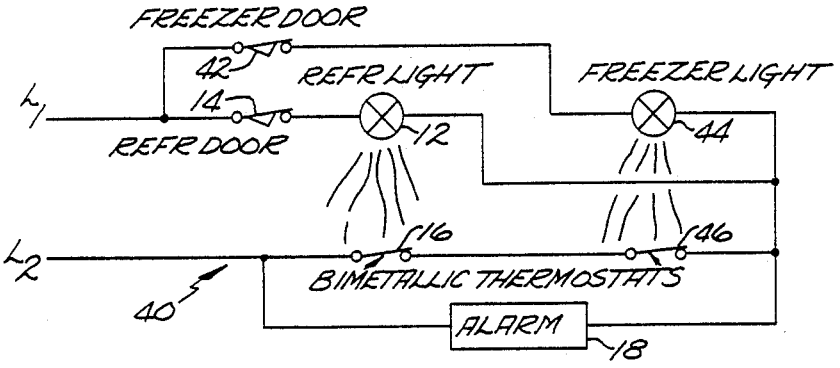

FIG. 3 shows a system 40 in which separate door switches are provided for a plurality of bulbs which still utilizes a single alarm indicator 18. First and second door switches, such as refrigerator door switch 14 and freezer door switch 42 are connected in parallel with each other and each is connected serially to light bulb 12, 44, respectively. Thermostatic switches 16 and 46 are mounted in heat transfer relation with bulbs 12, 44, respectively, with alarm indicator 18 coupled across the thermostatic switches 16, 46 as in FIG. 2 embodiment.

Figure 4:
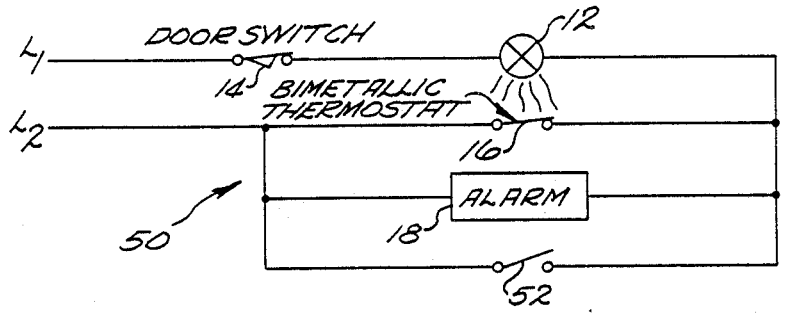

FIG. 4 shows an embodiment in which a manual override is provided so that the appliance door can, if desired, be intentionally left open for an extended period of time to permit cleaning or the like without actuating the alarm indicator. System 50 includes door switch 14, bulb 12, thermostatic switch 16 and alarm indicator 18 as in the previously described embodiments but also includes an alarm shut-off switch 52. Switch 52 is preferably a snap acting or detented door switch that can be manually actuated. To silence the alarm when the door is opened switch 52 is manually actuated to close its contacts thereby bypassing alarm indicator 18 preventing its energization even when switch 16 opens. When the door is closed shut-off switch 52 is automatically reset to the open position and remains in that condition by virtue of its detented operation until manually operated again.

It will be understood that switch 52 can be used with the FIG. 2 embodiment or two such switches could be used in the FIG. 3 embodiment if desired.

Although the invention has been described with respected to certain specific preferred embodiments thereof, many variations and modifications will become apparent to those skilled in the art. It is the intent that the appended claims be interpreted as broadly as possible in view of the prior art to include all such variations and modifications.

What is claimed:

1. An appliance door alarm indicator system for providing an indication that a door has been left ajar for longer than a preselected period comprises a heat generating light bulb, a normally closed thermostatic switch mounted in heat transfer relation with the light bulb, an appliance door switch adapted to be closed when the appliance door is open and open when the appliance door is closed, the door switch electrically connected in series with the light bulb and the thermostatic switch, an electrically energizable alarm indicator coupled across the thermostatic switch so that when the thermostatic switch receives sufficient heat from the bulb to cause it to move to an open contacts position the alarm indicator is concomitantly energized.

2. An appliance door alarm indicator system according to claim 1 in which the alarm indicator is a piezoelectric buzzer unit.

3. An appliance door alarm indicator system according to claim 1 in which the impedance of the alarm indicator is sufficiently high that the light bulb is substantially de-energized when the alarm indicator is energized.

4. An appliance door alarm indicator system according to claim 3 in which the light bulb is 40 watts and the alarm indicator includes an impedance of greater than 3600 ohms.

5. An appliance door alarm indicator system according to claim 1 further including a manually operable disabling switch coupled across the alarm indicator, the disabling switch being normally open but when manually operated being closed until it is reset, the disabling switch automatically resetable upon closing the door.

6. An appliance door alarm indicator system according to claim 1 further including a plurality of light bulbs and a thermostatic switch mounted in heat conductive relation with each light bulb, the thermostatic switches connected serially together and the alarm indicator connected across the thermostatic switches.

7. An appliance door alarm indicator system according to claim 6 further including a door switch electrically connected in series with each light bulb, each door switch and its respective light bulb connected in parallel with each other.

* * * * *